US009660387B2

(12) United States Patent
Lee

(10) Patent No.: US 9,660,387 B2
(45) Date of Patent: May 23, 2017

(54) CONNECTOR AND METHOD OF MANUFACTURING THE SAME

(71) Applicant: SAMSUNG DISPLAY CO., LTD., Yongin-si, Gyeonggi-do (KR)

(72) Inventor: Minsu Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/954,697

(22) Filed: Nov. 30, 2015

(65) Prior Publication Data

US 2016/0294120 A1 Oct. 6, 2016

(30) Foreign Application Priority Data

Apr. 3, 2015 (KR) ..... 10-2015-0047491

(51) Int. Cl.

| | |
|---|---|
| ***H01R 13/719*** | (2011.01) |
| ***H01R 13/648*** | (2006.01) |
| ***H01R 13/66*** | (2006.01) |
| *H01R 43/16* | (2006.01) |

(52) U.S. Cl.

CPC ..... *H01R 13/6485* (2013.01); *H01R 13/6641* (2013.01); *H01R 43/16* (2013.01)

(58) Field of Classification Search

CPC H01R 13/665; H01R 13/719; H01R 13/7195; H01R 23/7073; H01R 13/6666; H01R 13/6464; H01R 23/025

USPC ..... 439/620.08, 620.09, 620.1, 620.12, 439/620.15, 620.16, 620.21, 620.22, 516

See application file for complete search history.

(56) References Cited

U.S. PATENT DOCUMENTS

| | | | | |
|---|---|---|---|---|
| 4,654,743 | A * | 3/1987 | Ruehl | H04Q 1/146 361/111 |
| 4,929,196 | A * | 5/1990 | Ponn | H01R 13/7195 333/185 |
| 5,248,266 | A * | 9/1993 | Clyatt, III | H01R 13/7195 333/185 |
| 5,587,884 | A * | 12/1996 | Raman | H01R 13/665 333/182 |
| 7,885,076 | B2 * | 2/2011 | Sharifipour | H05K 7/20463 174/541 |
| 8,602,821 | B2 * | 12/2013 | Fujisaki | H01R 13/6625 439/606 |
| 8,627,563 | B2 * | 1/2014 | Wing | B29C 45/14639 29/832 |
| 8,879,265 | B2 * | 11/2014 | Kishikawa | H05K 5/068 174/17.05 |

(Continued)

FOREIGN PATENT DOCUMENTS

| | | | |
|---|---|---|---|
| JP | 2007-529189 | A | 10/2007 |
| JP | 2008-130272 | A | 6/2008 |
| KR | 10-2006-0010414 | A | 2/2006 |

*Primary Examiner* — Gary Paumen
(74) *Attorney, Agent, or Firm* — Innovation Counsel LLP

(57) ABSTRACT

A connector and a method of manufacturing the same are disclosed. The connector includes a module including at least one protection device and a connector frame formed by a mold, and the module is buried in the mold. The connector further includes a plurality of connection pins that are connected to the connector frame, and each of the plurality of connections pins has an exposed portion. Each of the plurality of connection pins is exposed, and at least a first set of the plurality of connection pins is electrically connected to the at least one protection device.

14 Claims, 4 Drawing Sheets

(56) References Cited

U.S. PATENT DOCUMENTS

| | | | | |
|---|---|---|---|---|
| 2002/0168899 | A1* | 11/2002 | Matsumoto | H01R 13/6616 439/620.21 |
| 2005/0201035 | A1 | 9/2005 | Buckmeier et al. | |
| 2006/0030216 | A1* | 2/2006 | Horiba | H01R 13/6477 439/620.09 |
| 2009/0251841 | A1 | 10/2009 | Whalin et al. | |
| 2012/0184142 | A1* | 7/2012 | Furukawa | H01R 43/24 439/620.22 |
| 2015/0056864 | A1* | 2/2015 | Yamamoto | H01R 13/6658 439/620.22 |

* cited by examiner

CONNECTOR AND METHOD OF MANUFACTURING THE SAME

RELATED APPLICATION

This application claims the benefit of Korean Patent Application No. 10-2015-0047491, filed on Apr. 3, 2015, in the Korean Intellectual Property Office, the disclosure of which is incorporated herein by reference in its entirety.

BACKGROUND

1. Field

One or more exemplary embodiments relate to a connector and a method of manufacturing the same.

2. Description of the Related Art

Recent advancements and refinements in the semiconductor industry have shrunk sizes of semiconductor devices. Due to their shrunken sizes, the semiconductor devices have become more vulnerable to an influence of electrostatic discharge (ESD) or a surge. Abnormalities caused by ESD can occur not only in semiconductor manufacturing processes but also in electronic parts and semiconductor devices manufactured by such semiconductor manufacturing processes.

A method of embedding a diode has been applied to prevent ESD in an integrated circuit (IC). However, an embedded diode may decrease a performance of the IC. To prevent a semiconductor device from ESD, a circuit including a transient voltage suppressor (TVS) diode has been used.

SUMMARY

One or more exemplary embodiments include a connector having a protection device and a method of manufacturing the same. Additional aspects will be set forth in part in the description which follows and, in part, will be apparent from the description, or may be learned by practice of the presented embodiments.

According to one or more exemplary embodiments, a connector includes: a module including at least one protection device; a connector frame formed by a mold, and the module is buried in the mold; and a plurality of connection pins connected to the connector frame. Each of the plurality of connection pins has an exposed portion, and at least a first set of the plurality of connection pins is electrically connected to the at least one protection device.

The electrical connection between the first set of the plurality of connection pins and the at least one protection device may be on a one-to-one basis through a connection wire.

The module may include a plurality of protection devices, wherein the plurality of protection devices may be electrically connected to the at least a portion of the plurality of connection pins on a one-to-one basis.

The module may include a plurality of protection devices that are the same as or less in number than the plurality of connection pins, wherein at least a second set of the plurality of protection devices may be electrically connected to the first of the plurality of connection pins on a one-to-one basis.

The electrical connection between the first set of the plurality of connection pins and the at least one protection device may be through a connection wire, wherein the connection wire may be buried in the connector frame.

Each of the at least one protection device may include a transient voltage suppressor (TVS) diode.

According to one or more exemplary embodiments, a method of manufacturing a connector includes: providing a module including at least one protection device, and a structure of a plurality of connection pins of the connector; and forming a connector frame by a molding process, wherein the at least one protection device is buried in the connector frame, and each of the plurality of connection pins has an exposed portion from the connector frame.

The method of manufacturing the connector further comprising electrically connecting the plurality of connection pins to the at least one protection device through a connection wire, wherein the at least one protection device is buried by the molding process after the electrical connecting.

The module may include a plurality of protection devices, wherein the first set of the plurality of connection pins may be electrically connected to at least a second set of the plurality of protection devices on a one-to-one basis through a connection wire.

Electrical connection between the first set of plurality of connection pins and the at least one protection device may be selectively achieved after forming the connector frame.

The module may include a plurality of protection devices corresponding to a number of connection pins.

Each of the plurality of protection devices may include a transient voltage suppressor (TVS) diode.

The module may include a plurality of protection devices that are less in number than the plurality of connection pins.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
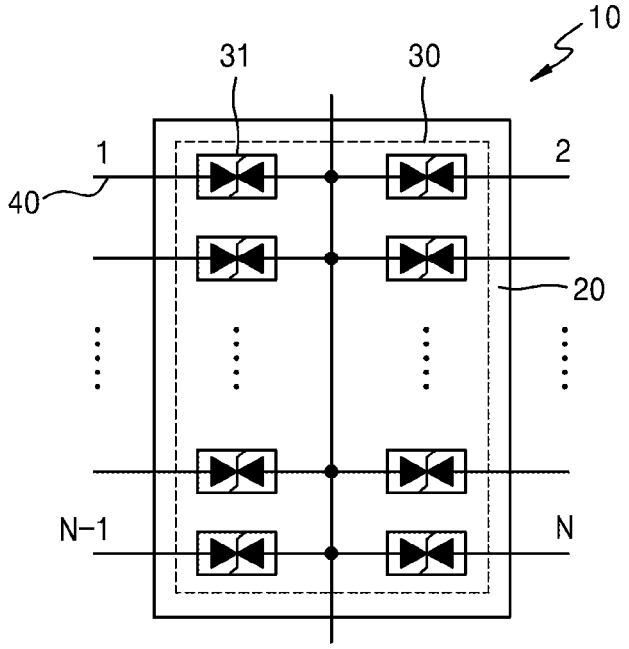
FIG. 1 illustrates a conceptual diagram of a connector, according to an embodiment.

Reference will be made in detail to exemplary embodiments, examples of which are illustrated in the accompanying drawings, wherein like reference numerals refer to like elements throughout. In this regard, the present exemplary embodiments may have different forms and should not be construed as being limited to the examples and descriptions set forth herein. Accordingly, the exemplary embodiments are merely described below, by referring to the figures, to explain aspects of the present description.

As used herein, the singular forms "a," "an," and "the" are intended to include the plural forms, unless the context clearly indicates otherwise. It will be further understood that the terms "comprise(s)" and/or "comprising" used herein specify a presence of stated features or components, but do not preclude a presence or an addition of one or more other features or components. It will be understood that when a layer, region, or component is referred to as being "formed on," another layer, region, or component, the layer, region, or component can be directly or indirectly formed on the another layer, region, or component. That is, for example, one or more intervening layers, regions, or components may be present.

Sizes of features and elements in the drawings may be exaggerated for convenience of explanation. In other words, sizes and thicknesses of components in the drawings may be arbitrarily illustrated, and the following embodiments may not be limited thereto.

When a certain embodiment may be implemented differently, a specific process order may be performed differently from a described order. For example, two consecutively described processes may be performed substantially at the same time or performed in an order opposite to a described order.

As used herein, the term "and/or" includes any and all combinations of one or more of the associated listed items. Expressions such as "at least one of," when preceding a list of elements, may modify the entire list of elements and may not modify the individual elements of the list. On an electronic board such as a printed circuit board (PCB), a flexible PCB (FPCB), or the like, a connector for intermediating connection to a plurality of electronic boards or other terminals and various kinds of electronic parts including a semiconductor chip may be provided.

When a protection device is separately arranged in an electronic board, such as a PCB, an FPCB, or the like. For example, a transient voltage suppressor (TVS) diode arranged on a circuit wiring that is weak to static electricity, a transient voltage, or the like, a number of TVS diodes are needed to protect electronic parts that are weak to static electricity, a transient voltage, or the like, and thus, an additional space for the TVS diodes may be required. A connector according to one or more of exemplary embodiments has a structure in which a protection device is buried in a connector frame mold so that such a separate space for the protection device is not required.

Figure 2:
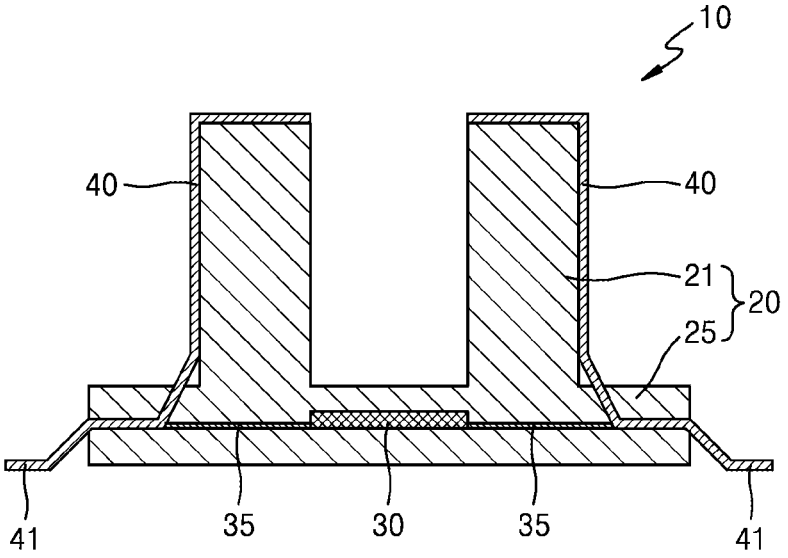
FIG. 2 illustrates a cross-sectional view of the connector, according to an embodiment.

FIG. 1 illustrates a conceptual diagram of a connector 10, according to an exemplary embodiment. FIG. 2 illustrates a cross-sectional view of the connector 10, according to an exemplary embodiment. Referring to FIGS. 1 and 2, the connector 10 includes a connector frame 20, a plurality of connection pins 40, and a module 30 including at least one protection device 31.

The connector frame 20 may be formed by a mold such that the module 30 is buried therein. The plurality of connection pins 40 are provided to the connector frame 20 such that at least a portion of each of the plurality of connection pins 40 is exposed from the connector frame 20. For example, the connector frame 20 may include a base part 25 and a protruding part 21 that protrudes from the base part 25. At least a portion of each of the plurality of connection pins 40 is exposed on the protruding part 21. The base part 25 and the protruding part 21 may be formed on a body of the connector 10. When the connector 10 has a structure to be mounted on an electronic board such as a PCB, an FPCB, or the like (e.g., a board-to-board connector), the base part 25 of the connector 10 may be a substrate of the electronic board or a part coupled to the electronic board. When the base part 25 is coupled to the electronic board, the base part 25 is closely coupled to the electronic board simultaneously when the connector 10 is fixed to the electronic board by bonding (e.g., wire-bonding or solder-bonding) terminals 41 of the plurality of connection pins 40 of the connector 10 to the electronic board.

The connector frame 20 may be formed of a mold material (e.g., a resin) by a molding process. The plurality of connection pins 40 may be arranged to be exposed at an inner side or an outer side of the protruding part 21. FIG. 2 shows an example in which the plurality of connection pins 40 are arranged to be exposed at an outer side of the protruding part 21 such that the connector 10 is a male connector. A female connector to be coupled to the male connector for an electrical connection between the two connectors may have a plurality of connection pins arranged at an inner side of a protruding part. FIG. 2 merely illustrates an embodiment where the connector 10 is a male connector, the present embodiment is not limited thereto. That is, the connector 10 according to an exemplary embodiment may be formed to be a female connector.

For example, when the connector 10 is a male connector, as illustrated in FIG. 2, the plurality of connection pins 40 may be arranged to be exposed at an upper side surface and an outer side surface of the protruding part 21. In this case, an opposite female connector (not shown) to be coupled to the connector 10 may be formed with a plurality of connection pins exposed at an inner side surface of a protruding part and/or an inner side bottom surface of a base part in the female connector into which the protruding part 21 is to be inserted.

As another example, the connector 10 may be formed with a plurality of connection pins 40 only exposed at an upper side surface of the protruding part 21, and the rest of the connection pins 40 is buried in the protruding part 21 and the base part 25 with the exposed terminals 41 extending from the base part 25. In this case, an opposite female connector (not shown) to be coupled to the connector 10 may be formed with a plurality of connection pins exposed only at an inner side bottom surface of a base part or with a plurality of connection pins exposed at an inner side surface of a protruding part and the inner side bottom surface of the base part in the female connector into which the protruding part 21 is to be inserted.

As yet another example, the connector 10 may be formed with a plurality of connection pins 40 only exposed at an outer side surface of the protruding part 21. In this case, an opposite female connector (not shown) to be coupled to the connector 10 may be formed with a plurality of connection pins only exposed at an inner side surface of a protruding part or with a plurality of connection pins exposed at the inner side surface of the protruding part and an inner side bottom surface of a base part in the female connector into which the protruding part 21 is to be inserted.

It is noted that FIG. 2 shows an example where the connector 10 is a male connector is described. However, when the connector 10 is a female connector, the connector 10 has a structure corresponding to a male connector structure, and the female connector structure can be sufficiently inferred, and thus drawings and detailed description thereof are omitted. Hereinafter, exemplary embodiments where the connector 10 is a male connector will be described with reference to the examples described below for convenience of description. Since various modified examples for a female connector structure can be sufficiently inferred, detailed descriptions of the modified examples are omitted if appropriate.

The module 30 (e.g., a semiconductor chip) may include at least one protection device 31 on a semiconductor substrate. When the connector frame 20 is formed using a mold, the module 30 may be buried in the base part 25 of the connector frame 20. The protection device 31 suppresses or prevents static electricity or a transient voltage. For example, a TVS diode may be provided as the protection device 31.

According to one embodiment, the module 30 has a structure in which a plurality of protection devices 31 are formed on a substrate in an array. In this case, the plurality of protection devices 31 are electrically connected to at least some of the plurality of connection pins 40 on a one-to-one basis. Based on the total number of connection pins 40 in the connector 10 and the number of protection devices 31 to be connected to the connection pins 40, the number of protection devices 31 included in the module 30 may vary.

The module 30 may include a desired number of protection devices 31 so that at least a portion of the plurality of connection pins 40 is electrically connected to the protection devices 31 on a one-to-one basis. For example, as shown in FIG. 1, the module 30 is provided with a plurality of protection devices 31 that corresponds to the number of connection pins 40 such that the plurality of protection devices 31 and the plurality of connection pins 40 are electrically connected to each other on a one-to-one basis. In this case, the one-to-one electrical connection between each connection pin 40 and each protection device 31 may be achieved using a connection wire 35.

When the plurality of connection pins 40 are electrically connected to the plurality of protection devices 31 on a one-to-one basis, the connector frame 20 may be formed such that the protection devices 31 are buried in the connector frame 20 by a molding process, and the connection pins 40 are electrically connected to the protection devices 31 on a one-to-one basis by using connection wires 35. In this case, as shown in FIG. 2, the connection wires 35 may also be buried together with the protection devices 31 in the base part 25 of the connector frame 20.

Figure 3:
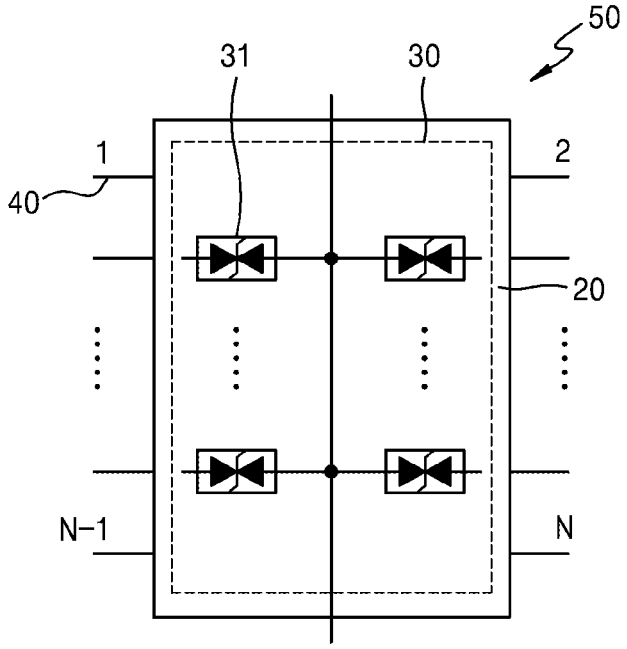
FIG. 3 illustrates a conceptual diagram of a connector, according to another embodiment.
Figure 4:
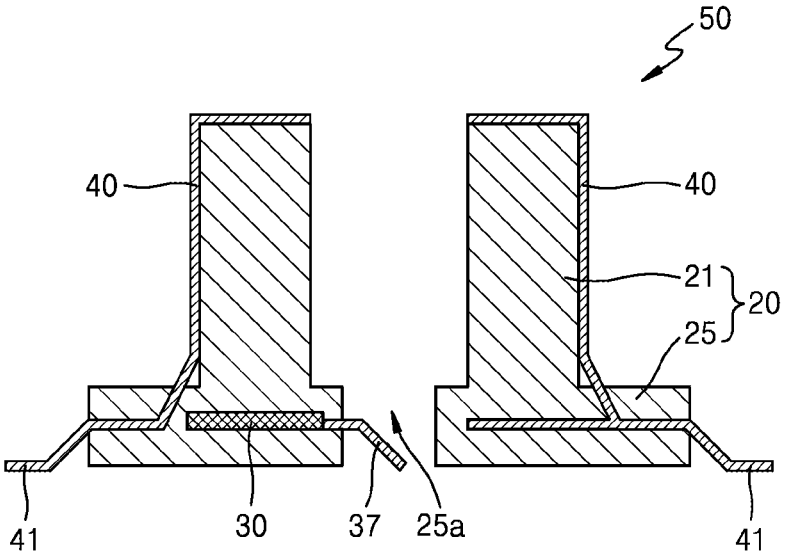
FIG. 4 illustrates a cross-sectional view of the connector, according to another embodiment.

FIG. 3 illustrates a conceptual diagram of a connector 50, according to another exemplary embodiment. FIG. 4 illustrates a cross-sectional view of the connector 50, according to another exemplary embodiment. The connector 50 in FIGS. 3 and 4 differs from the connector 10 of FIGS. 1 and 2 in that the module 30 includes a plurality of protection devices 31 that are the same as or less in number than a plurality of connection pins 40, and at least a portion of the plurality of protection devices 31 is electrically and selectively connectable to a portion of the plurality of connection pins 40 on a one-to-one basis.

For example, the module 30 may include one or more protection devices 31 such that the protection devices 31 are electrically connectable to some connection pins 40 that require electrical protection on a one-to-one basis. That is, the module 30 may include a smaller number of protection devices 31 than a plurality of connection pins 40, and accordingly, a portion of the plurality of connection pins 40 may be electrically connected to protection devices 31 on a one-to-one basis. In this case, the electrical connection between the connection pins 40 and the protection devices 31 in the connector 50 may be selectively achieved only for necessary connection pins 40 after forming the connector frame 20 by a molding process to bury the module 30 including the protection devices 31.

FIG. 3 shows, as an example, a state before electrical connection between protection devices 31 and connection pins 40 wherein the number of protection devices 31 is less than the number of connection pins 40. The cross-sectional view of FIG. 4 shows that the base part 25 of the connector frame 20 is formed in a structure having an open portion 25*a* so that the electrical connection between a connection pin 40 and a protection device 31 is achieved later only for necessary cases after forming the connector frame 20 by a molding process to bury the module 30 including the protection devices 31. When connection pins 40 are provided in a structure as separated from protection devices 31 instead of being connected to protection devices as shown in FIG. 2, the protection devices 31 may be selectively connected to wiring lines for electrical protection such as an FPCB or PCB circuit.

The connector 10 or 50 according to the exemplary embodiments described above may be manufactured as below. For example, first, the module 30 including at least one protection device 31 and a structure of a plurality of connection pins 40 for the connector 10 or 50 are prepared. Next, the connector frame 20 having a structure having the base part 25 and the protruding part 21 is formed. The module 30 including the at least one protection device 31 is buried, for example, by a molding process using a mold resin or the like. During the molding process, the connector frame 20 is formed such that the module 30 including the at least one protection device 31 is buried in the base part 25, and at least a portion of each of the plurality of connection pins 40 is exposed at the protruding part 21.

The plurality of connection pins 40 may be electrically connected to the at least one protection device 31 using the connection wires 35, and the connector frame 20 is formed such that the module 30 including the at least one protection device 31 is buried by molding, and the plurality of connection pins 40 and the at least one protection device 31 are electrically connected using the connection wires 35. In this case, as shown in FIG. 2, the connection wires 35 may also be buried together with the at least one protection device 31 in the base part 25 of the connector frame 20.

As another example, the electrical connection between a connection pin 40 and a protection device 31 may be selectively achieved after forming the connector frame 20. As such, when a structure in which the connection pin 40 and the protection device 31 are separated from each other instead of being connected to each other, a connection wire (not shown) for electrically connecting the connection pin 40 and the protection device 31 is not buried in the connector frame 20. In this case, as shown in FIG. 4, the base part 25 of the connector frame 20 may be formed in a structure having an open portion 25*a*, and a connection terminal 37 of each protection device 31 of the module 30 is exposed from the base part 25. In this case, the connection pin 40 may be electrically connected to the protection device 31 by selectively, where necessary, connecting the connection terminal 37 of each protection device 31 of the module 30 to the connection pin 40 using a connection wire (not shown).

As described above, according to the one or more of the above exemplary embodiments, a module including a protection device is buried in a connector frame when a mold of the connector frame is formed. Since a protection device for protecting a circuit from ESD from outside, a transient voltage, or the like does not have to be separately mounted, a space for mounting the protection device saved, and this may be particularly helpful for circuit integration. In addition, a semiconductor process and a connector producing process after producing a protection device may be unified, and a manufacturing unit price may be lowered than a case where individual parts are formed separately and later integrated.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments. While one or more exemplary embodiments have been described with reference to the figures, it will be understood by those of ordinary skill in the art that various changes in form and details may be made therein without departing from the spirit and scope of the present disclosure.

What is claimed is:

1. A connector comprising:

a module comprising at least one protection device;

a connector frame formed by a mold, wherein the module is buried in the mold;

a plurality of connection pins connected to the connector frame; and a connection wire connected to the protection device, wherein each of the plurality of connection pins has an exposed portion, wherein at least a first set of the plurality of connection pins is electrically connected to the at least one protection device, and wherein the connector frame has an open portion through which at least a portion of the connection wire is exposed.

2. The connector of claim 1, wherein the electrical connection between the first set of the plurality of connection pins and the at least one protection device is on a one-to-one basis through a connection wire.

3. The connector of claim 1, wherein the module comprises a plurality of protection devices, wherein the plurality of protection devices are electrically connected to the first set of the plurality of connection pins on a one-to-one basis.

4. The connector of claim 1, wherein the module comprises a plurality of protection devices that are the same as or less in number than the plurality of connection pins, wherein at least a second set of the plurality of protection devices is electrically connected to the first set of the plurality of connection pins on a one-to-one basis.

5. The connector of claim 1, wherein the electrical connection between the first set of the plurality of connection pins and the at least one protection device is through a connection wire, wherein the connection wire is buried in the connector frame.

6. The connector of claim 5, wherein each of the at least one protection device comprises a transient voltage suppressor (TVS) diode.

7. The connector of claim 1, wherein each of the at least one protection device comprises a transient voltage suppressor (TVS) diode.

8. A method of manufacturing a connector, the method comprising:

providing a module including at least one protection device, and a structure of a plurality of connection pins of the connector;

forming a connector frame by a molding process, wherein the at least one protection device is buried in the connector frame, and each of the plurality of connection pins has an exposed portion from the connector frame; and selectively connecting the first set of the plurality of connection pins and the at least one protection device after forming the connector frame.

9. The method of claim 8, further comprising electrically connecting the plurality of connection pins to the at least one protection device through a connection wire, wherein the at least one protection device is buried by the molding process after the electrical connecting.

10. The method of claim 9, wherein the module comprises a plurality of protection devices, wherein the first set of the plurality of connection pins is electrically connected to at least a second set of the plurality of protection devices on a one-to-one basis through a connection wire.

11. The method of claim 8, wherein the module comprises a plurality of protection devices corresponding to a number of connection pins.

12. The method of claim 11, wherein each of the at least one protection device comprises a transient voltage suppressor (TVS) diode.

13. The method of claim 8, wherein the module comprises a plurality of protection devices that are less in number than the plurality of connection pins.

14. The method of claim 13, wherein each of the plurality of protection devices comprises a transient voltage suppressor (TVS) diode.

* * * * *